US007448563B2

(12) United States Patent
Berger et al.

(10) Patent No.: US 7,448,563 B2
(45) Date of Patent: Nov. 11, 2008

(54) DE-JAMMING DEVICE AND METHOD

(75) Inventors: Thomas R. Berger, Racine, WI (US); William F. Strutz, Racine, WI (US); Nicholas J. Hirsch, Wind Lake, WI (US); Gregory A. Peterson, South Barrington, IL (US); Ralph D. Furmanek, Wildwood, MO (US); Arthur E. Woodward, Manchester, MO (US)

(73) Assignee: Emerson Electric Co., St. Louis, MO (US)

( * ) Notice: Subject to any disclaimer, the term of this patent is extended or adjusted under 35 U.S.C. 154(b) by 237 days.

(21) Appl. No.: 10/908,096

(22) Filed: Apr. 27, 2005

(65) Prior Publication Data

US 2006/0032951 A1 Feb. 16, 2006

Related U.S. Application Data

(60) Provisional application No. 60/521,445, filed on Apr. 27, 2004.

(51) Int. Cl.
*B02C 25/00* (2006.01)

(52) U.S. Cl. ..... 241/30; 241/36; 241/46.013

(58) Field of Classification Search ..... 241/30, 241/36, 46.013
See application file for complete search history.

(56) References Cited

U.S. PATENT DOCUMENTS

| | | | | |
|---|---|---|---|---|
| 2,851,646 | A | 9/1958 | Williamson et al. | |
| 3,545,684 | A | 12/1970 | Ruspino et al. | |
| 3,970,907 | A | 7/1976 | Meyers | |
| 4,026,480 | A | 5/1977 | Meyers | |
| RE30,068 | E | 8/1979 | Meyers | |
| 4,665,286 | A | 5/1987 | Hansen | |
| 6,481,652 | B2 | 11/2002 | Strutz | |
| 6,648,252 | B2 * | 11/2003 | Strutz | 241/46.013 |
| 6,854,673 | B2 | 2/2005 | Strutz et al. | |
| 7,048,213 | B2 | 5/2006 | Strutz | |
| 2002/0063178 | A1 | 5/2002 | Strutz et al. | |
| 2002/0104909 | A1 * | 8/2002 | Strutz | 241/46.013 |

OTHER PUBLICATIONS

International Search Report for corresponding International Application No. PCT/US2005/014587.
Written Opinion of the International Searching Authority for corresponding International Application No. PCT/US2005/014587.

* cited by examiner

*Primary Examiner*—Faye Francis
(74) *Attorney, Agent, or Firm*—Harness, Dickey & Pierce, P.L.C.

(57) ABSTRACT

A system and method for automatically applying a de-jamming action in response to a jammed rotating member includes applying a pulsed torque in response to a detected jam, and additionally a reversal in the direction of rotation may be applied.

20 Claims, 6 Drawing Sheets

DE-JAMMING DEVICE AND METHOD

CROSS-REFERENCE TO RELATED APPLICATION

This application is a non-provisional application of U.S. Provisional Patent Application Ser. No. 60/521,445, filed on Apr. 27, 2004, which is incorporated by reference.

BACKGROUND

The present disclosure relates to rotating devices such as the rotating portions of a food waste disposer grind mechanism.

There are many motor applications in which a motor's rotating member is subject to jams. This may be particularly common in applications such as water pumps, dishwashers, food processing equipment, food waste disposers, etc.

For example, food waste disposers are used to comminute food scraps into particles small enough to safely pass through household drain plumbing. A conventional disposer includes a food conveying section, a motor section, and a grinding mechanism disposed between the food conveying section and the motor section. The food conveying section includes a housing that forms an inlet for receiving food waste and water. The food conveying section conveys the food waste to the grinding mechanism, and the motor section includes a motor imparting rotational movement to a motor shaft to operate the grinding mechanism.

The grind mechanism that accomplishes the comminution is typically composed of a rotating shredder assembly with lugs and a stationary grind ring. The motor turns the shredder plate and the lugs force the food waste against the grind ring where it is broken down into small pieces. Once the particles are small enough to pass out of the grinding mechanism, they are flushed out into the household plumbing.

Grind mechanisms that utilize a fixed lug on the rotating shredder assembly are often susceptible to jams when grinding hard food waste, such as beef bones. The use of an induction motor may contribute to the probability of experiencing a jam because of its relatively low stall torque. To reduce the occurrences of jams, swivel, or rotatable, lugs that move out of the way before a jam can occur are employed. However, with swivel lugs, the energy displaced to the food waste is less and therefore can result in compromised grind performance and still lead to jams.

To free jams, some known systems use a technique that produces a pulsating torque from the motor when the disposer becomes "jammed". Such a prior art technique is described in U.S. Pat. No. 3,970,907, which is incorporated by reference. The technique connects a diode in parallel across the start winding of a capacitor start motor to produce the pulsating torque. The parallel diode however, cannot be applied during starting. If it is, the motor will not be able to accelerate to full speed, and the capability of the disposer will be greatly reduced. It can only be applied after a jam of the grinding mechanism occurs. Because of the starting issue, the parallel diode is only connected when the consumer pushes a button located on the disposer assembly. Moreover, such known systems for freeing jams require user intervention—when the operator of the notices that the disposer is jammed, the pulsating torque must be activated by the user.

The present application addresses shortcomings associated with the prior art.

SUMMARY

Among other things, the present disclosure provides an automatic method of clearing a jam of a rotating member, such as a food waste disposer's rotating grinding plate without any manual intervention by the consumer. Actions such as automatically generating a pulsed torque and reversing the direction of rotation clear a very high percentage of jams, requiring minimal manual intervention in clearing jams over the life of the system.

There are several advantages as compared to the prior art techniques. For example, with the device and methods disclosed herein, the circuit automatically senses when the motor is stalling or a jam occurs. The motor automatically reverses, and if this does not free the jam, the pulsating torque is automatically generated. Since all of this action is automatic, it requires no manual action by the operator of the unit and also does not interfere with the normal starting of the motor.

In accordance with certain teachings of the present disclosure, a method for operating a device driven by a motor, such as a food waste disposer, is presented. The method includes determining if a shredder plate of the food waste disposer is jammed. If the shredder plate is jammed, a pulsed torque is applied to the shredder plate. The pulsed torque may be applied for a predetermined time period. Additionally, the rotational direction of the shredder plate is reversed in certain embodiments.

To determine whether the rotating shredder plate is jammed, the speed of the shredder plate is monitored. If it fails to reach a predetermined speed during a predetermined time period or if it falls below a predetermined speed, a jam is indicated. In some embodiments, the disposer motor's run winding and/or start winding is monitored.

In accordance with further teachings of the present disclosure, a system such as a food waste disposer includes a motor driving a shaft that rotates a shredder plate for grinding food waste. A controller is coupled to the motor and determines whether the shredder plate is jammed. In response to a jam, the controller applies a pulsed torque to the shredder plate. The pulsed torque is applied for a predetermined time period in some embodiments. The controller may also reverse the rotational direction of the shredder plate.

In certain exemplary embodiments, the controller monitors the speed of the rotating shredder plate to determine whether the shredder plate is jammed. For instance, the controller may determine if the rotating shredder plate reaches a predetermined speed during a predetermined time period, or if the rotating shredder plate falls below a predetermined rotation speed.

In further exemplary embodiments, the controller monitors run windings and/or start windings of the motor to determine if the rotating shredder plate is jammed. To apply the pulsed torque, for example, the controller may activate an SCR connected in parallel with the motor start winding. A start capacitor may be connected in series with the start winding. In still further embodiments, an oscillator is connected to a gate terminal of the SCR.

BRIEF DESCRIPTION OF THE DRAWINGS

Other objects and advantages of the invention will become apparent upon reading the following detailed description and upon reference to the drawings in which.

Figure 1:
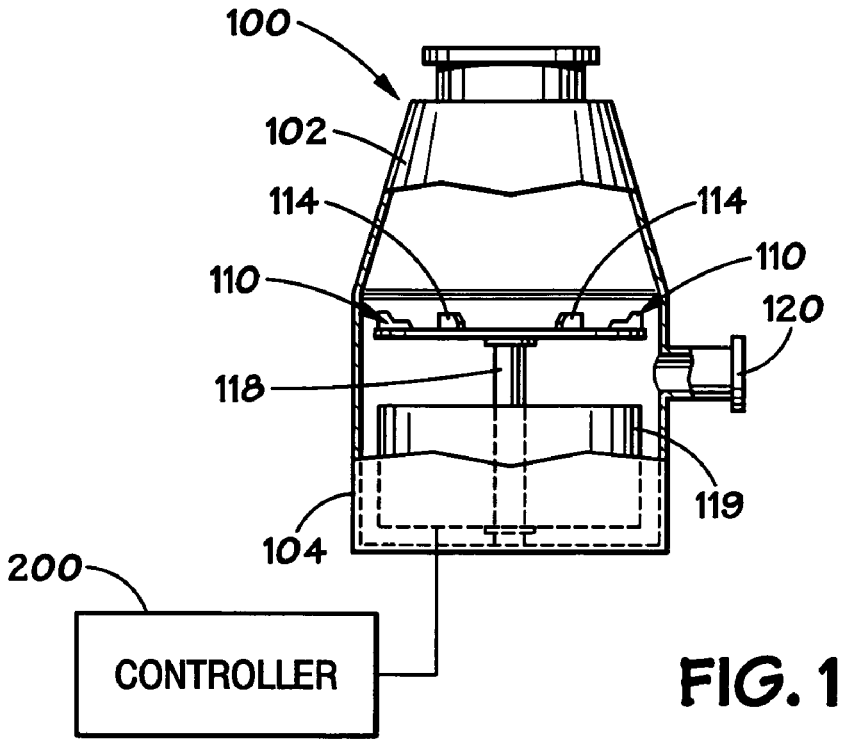
FIG. 1 is a diagram illustrating a food waste disposer in accordance with certain teachings of the present disclosure.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention.

DETAILED DESCRIPTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

FIG. 1 is a diagram conceptually illustrating a food waste disposer system in accordance with certain teachings of the present disclosure. The food waste disposer 100 includes a food conveying section 102 and a grinding mechanism 110, which is disposed between the food conveying section and a motor section 104. The food conveying section 102 includes an inlet for receiving food waste and water. The food waste is conveyed to the grinding mechanism 110, and the motor section 104 includes a motor 119 imparting rotational movement to a motor shaft 118 to operate the grinding mechanism 110. The motor may be any suitable type of motor, such as an induction motor, brushless permanent magnet motor (BLPM), DC motor, etc.

The grinding mechanism 110 includes a rotating shredder plate assembly 112 that is rotated relative to a stationary grind ring by the motor shaft 118 to reduce food waste delivered by the food conveying section to small pieces. The shredder plate includes lugs 114 extending therefrom that force the food waste against the grind ring. When the food waste is reduced to particulate matter sufficiently small, it passes from above the shredder plate assembly 112, and along with water passing through the food conveying section, is then discharged from the disposer through a discharge outlet 120. A controller 200 is connected to the motor to control operation of the disposer 100. In FIG. 1, the controller 200 is shown external to the disposer housing for simplicity, though it could be situated inside the disposer housing.

Figure 2:
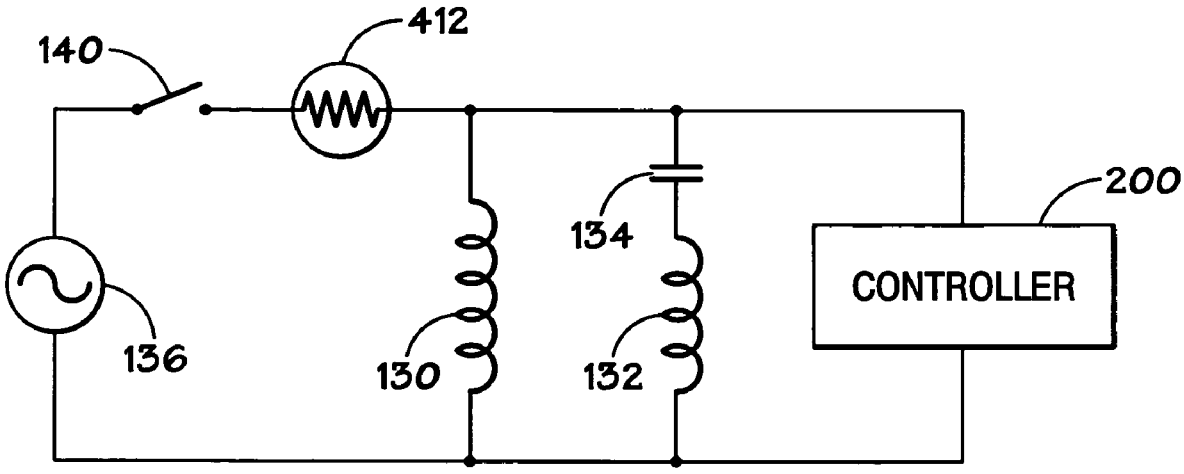
FIG. 2 is schematic diagram conceptually illustrating portions of the system shown in FIG. 1.

FIG. 2 illustrates portions of the motor 119, which includes a run winding 130 and a start winding 132 that is connected to a start capacitor 134. The motor 119 receives power from a power source 136 in response to a user operated on/off switch 140. The controller 200 is connected to control application of power to the windings to cause a rotating part (rotor) to turn relative to a stationary part (stator) to turn the shaft 118 connected to the rotating shredder plate 112. Additionally, the controller 200 is connected to monitor power applied to the windings 130, 132 and implement a de-jamming operation as necessary.

Figure 3:
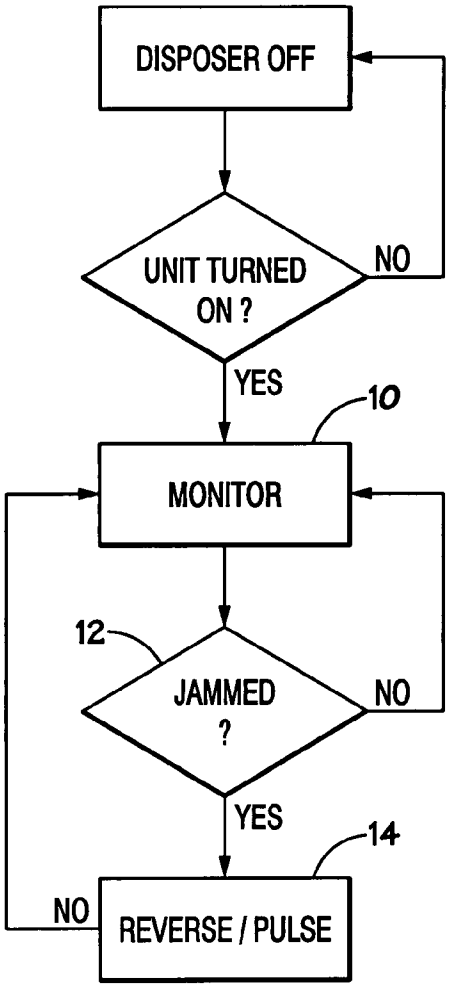
FIG. 3 is a simplified flow diagram conceptually illustrating a method of automatically freeing a jammed rotating member in accordance with aspects of the present disclosure.

FIG. 3 is a simplified flow diagram conceptually illustrating a method of automatically freeing a jammed rotating member, such as the rotating shredder plate 112 of the disposer 100. In accordance with certain aspects of the present disclosure, the controller 200 monitors operation of the motor to determine whether the rotating shredder plate 112 has become jammed (block 10). If the shredder plate 112 is jammed as determined in decision block 12, the rotational direction is reversed and a pulsed torque is applied to the shredder plate 112 by the motor 119 in block 14.

If a rotating member, such as the rotating shredder plate 112 of the food waste disposer's grind mechanism 110, fails to reach its desired operating speed during a predetermined time period, or if the rotating member's speed drops below the desired operating speed, it may be assumed that the rotating member is jammed. With any mechanism using a rotating member driven by a motor, there are many situations that cause rotating member to become stuck or jammed. As discussed in the Background section herein above, a jam can occur in a food waste disposer's rotating grind mechanism when a food particle or other hard object becomes wedged between a lug and the stationary portion of the grind mechanism.

Figure 4A:
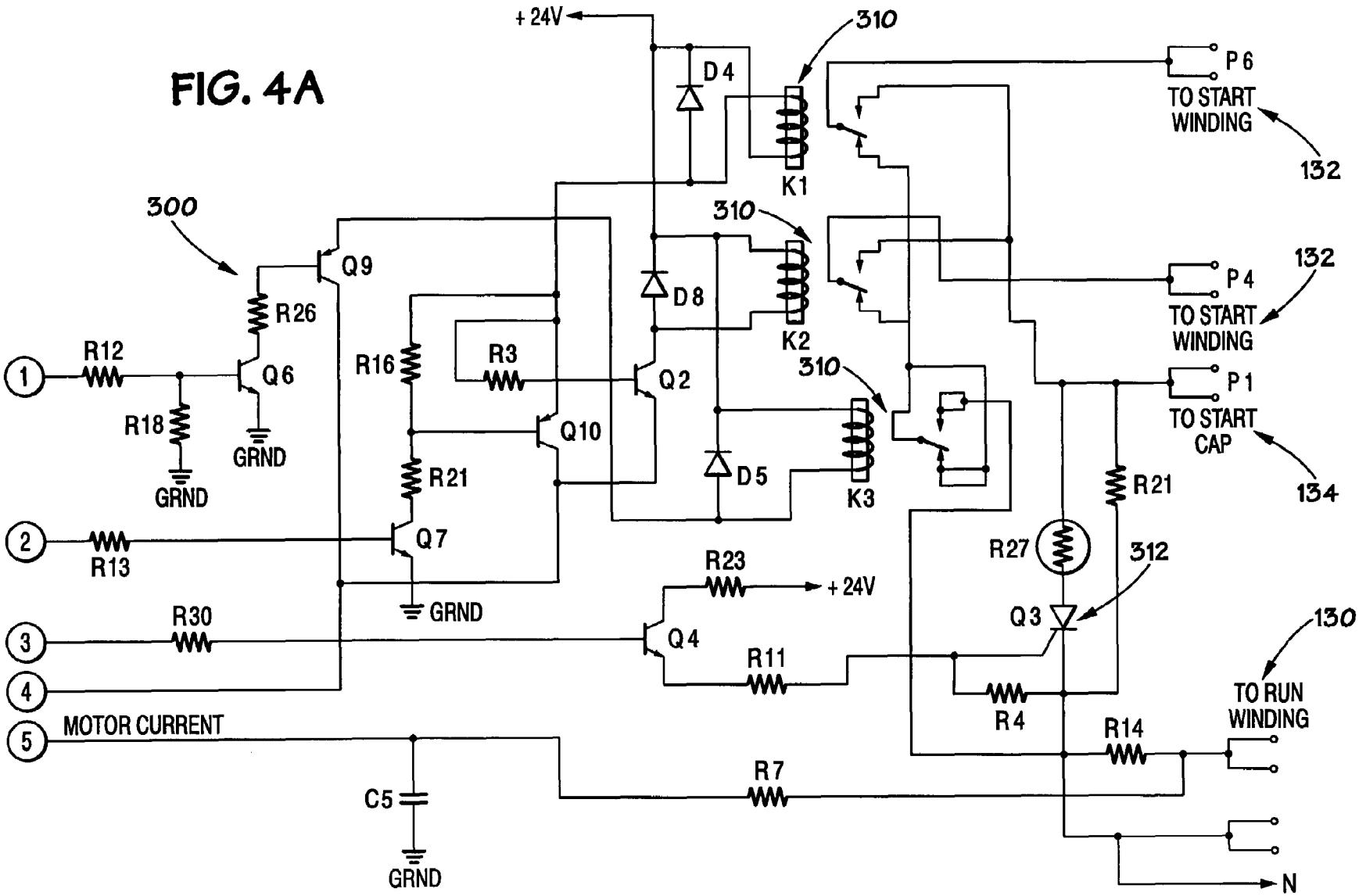
FIGS. 4A and 4B are a circuit diagram of an exemplary motor control circuit.
Figure 4B:
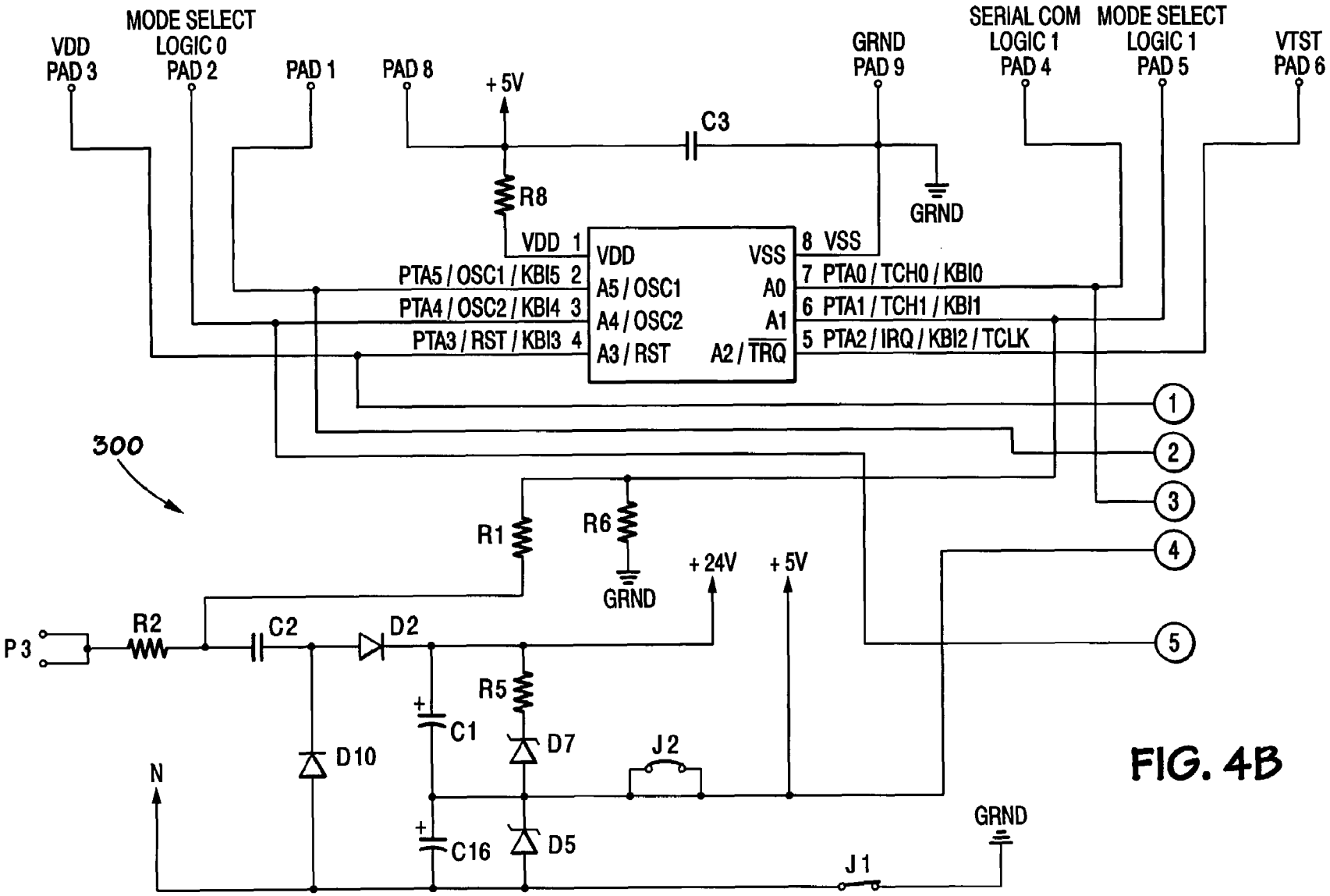
Figure 5A:
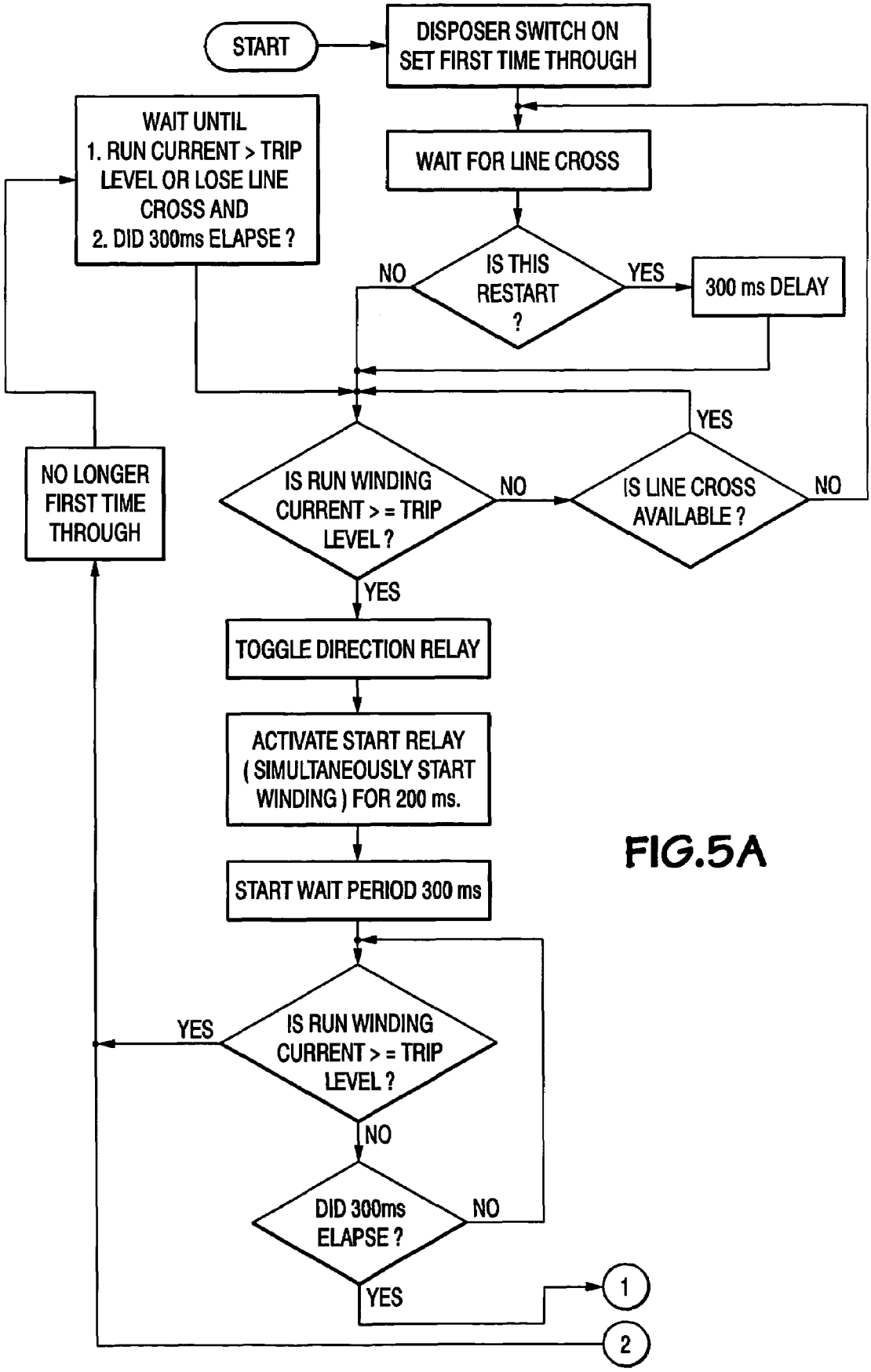
FIGS. 5A and 5B are a flow diagram of a method for sensing and freeing a jam in a rotating member.
Figure 5B:
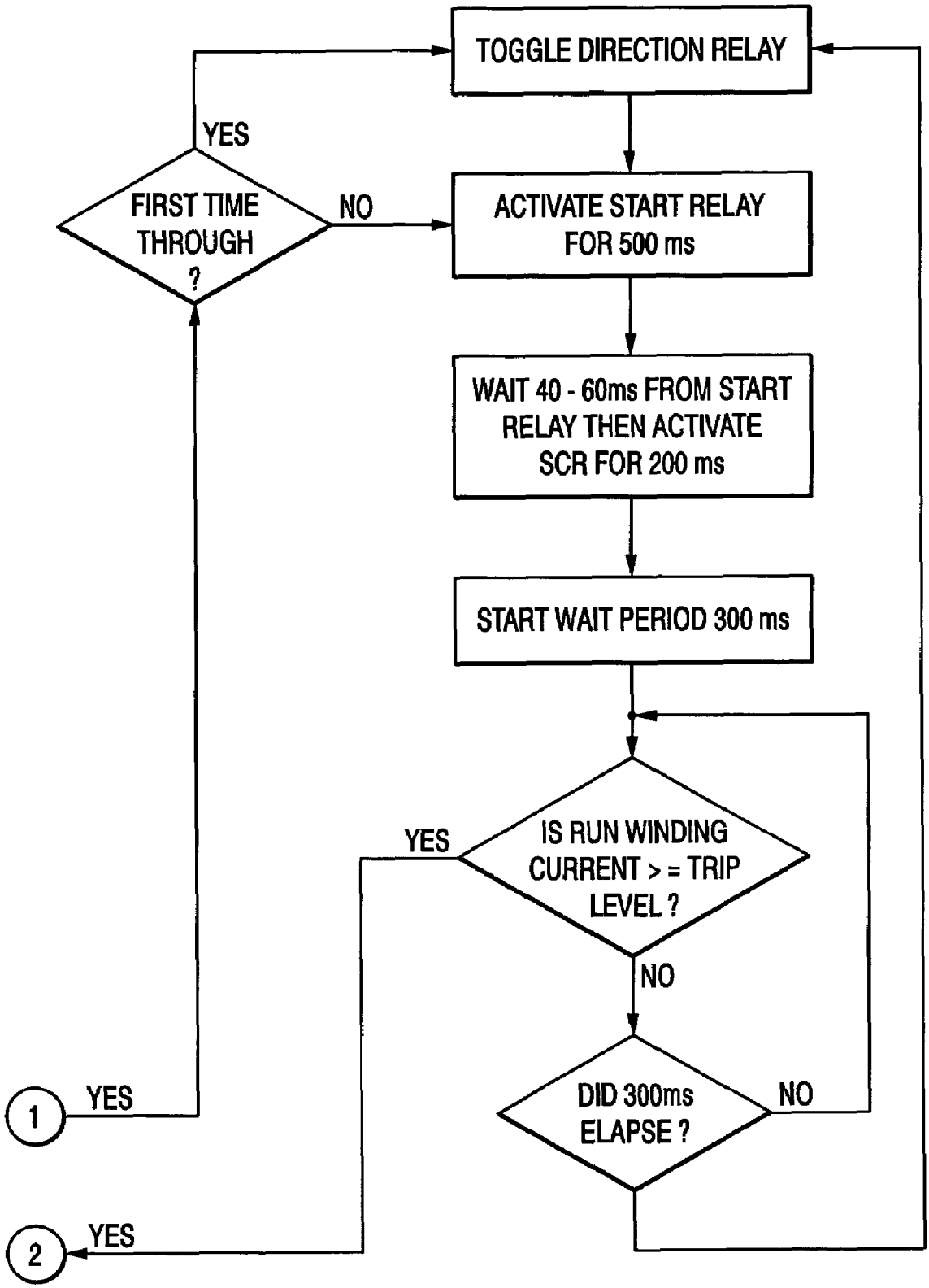

In response to sensing a jam, the controller 200 reverses the rotational direction of the shredder plate 112 and a pulsed torque is applied to the shredder plate 112 for a predetermined time period to free the jam. In exemplary embodiments disclosed herein, the motor's run winding 130 is monitored to determine whether the rotating member is operating at or above the desired speed. In other embodiments, the motor's start winding 132 is monitored to determine whether the rotating member is operating at or above the desired speed. Normally, current is removed from the start winding 132 once the motor 119 has reached the desired speed. Under normal conditions, the motor 119 should reach the desired speed within a predetermined time period. Thus, if current or voltage is applied to the start winding 132 longer than this predetermined time period, it may be assumed that a jam is preventing the rotating member 112 from reaching the desired speed FIGS. 4A and 4B illustrate an electronic circuit 300 in accordance with one exemplary embodiment, and FIGS. 5A and 5B show a corresponding flow diagram. The circuit 300 functions to electronically start the motor 119 and automatically reverse and activate a pulsating torque when the rotating portion of the motor becomes jammed 119. A novel sensing technique in the circuit allows the motor to start under normal conditions.

When the disposer 100 is not in use, the on/off switch 140 is open, the motor protector is closed and no current is flowing through the electronic circuit. When the user applies power to the motor 119 and the electronic circuit 300 by closing the on/off switch 140, the electronic circuit 300 senses the current in the run winding 130. When the current reaches a predetermined level, a start relay is activated for some predetermined time period—200 ms in the illustrated embodiment. The electronic circuit 300 checks for current drop in the run winding 130. If the current drops below the predetermined value, which will occur when the motor 119 comes up to speed, the electronic circuit 300 goes into run mode and monitors the run winding 130 current until the on/off switch 140 is opened by the user and no current flows through the electronic circuit. Once the electronic circuit 300 senses no current in the run winding 130 it will hold in memory (approximately 1 minute) the last rotation direction and if reactivated will toggle the relays 310 to start the motor in the opposite direction. If reactivated after 1 minute, the direction of rotation will be random. If a jam occurs during the initial start or after the initial start where the circuit enters a run mode, the circuit functions as follows in one exemplary implementation.

If, when the user initially applies power to the motor 119 and the electronic circuit 300 by closing the on/off switch 140, the current in the run winding 130 does not drop below the predetermined level because the rotating member 112 cannot come up to speed due to a jam, the circuit 300 enters the de-jam mode. The circuit 300 toggles relays 310 to reverse rotational direction, activates the start winding 132 for 500 ms and 40 ms later activates the de-jam circuit for 200 ms of the 500 ms. The de-jam circuit consists of a simple SCR 312 in parallel across the start winding 132. The electronic circuit 300 then checks the current level in the run winding 130. If the current doesn't drop below the predetermined level in 300 ms then the circuit toggles relays 310 to reverse rotational direction and activates the de-jam circuit as described above until the jam is free and the run winding 130 current falls or the user switches the on/off switch 140 to the off position or a motor protector switch opens.

During the pulsating torque mode, the SCR 312 is triggered on for only the positive or negative half cycles. When the SCR 312 is on, the start winding 132 is not active and the motor start capacitor 134 is being charged to the applied voltage. During the next half wave, the SCR 312 is not active. The start winding 132 is in series with the motor start capacitor 134, which has been charged to a voltage that adds to the applied voltage. This action and the relative phase relationships of the start and run windings 130, 132, generates a small torque to momentarily reverse the motor 119 and then applies a much larger positive torque to the rotating member. This positive torque may be as much as two to five times the normal starting torque of the motor 119. The current drawn through the motor windings is somewhat less than the current value when the rotating member is jammed since the start winding 132 is only active and allowing current flow every other half cycle of the alternating current. During a jammed condition, a thermal protector will open in about seven seconds to protect the motor windings from over heating. If a jam occurs that the pulsating torque cannot clear, the thermal protector will remove power and terminate the de-jam mode in approximately 7 seconds. At that point the user will have to reset the protector and remove the jam manually.

If, when the user initially applies power to the motor 119 and electronic circuit 300 by closing the on/off switch 140, the electronic circuit 300 goes into run mode but then due to a jam the current in the run winding 130 goes above the predetermined level, the circuit 300 toggles relays 310 to reverse the rotational direction and monitor the run current to determine if reversing the unit freed the jam. If the current remains above the set point after reversing, the electronic circuit reactivates the start winding in the same rotational direction for 500 ms and 40 ms later activates the de-jam circuit for 200 ms of the 500 ms (or some other predetermined time period). The electronic circuit then checks the current level in the run winding. If the current doesn't drop below the predetermined level in 300 ms, then the circuit 300 toggles relays 310 to reverse rotational direction and activates the de-jam circuit as described above until the jam is free and the run winding current falls or the motor protector opens or the consumer switches the on/off switch to the off position.

Figure 6:
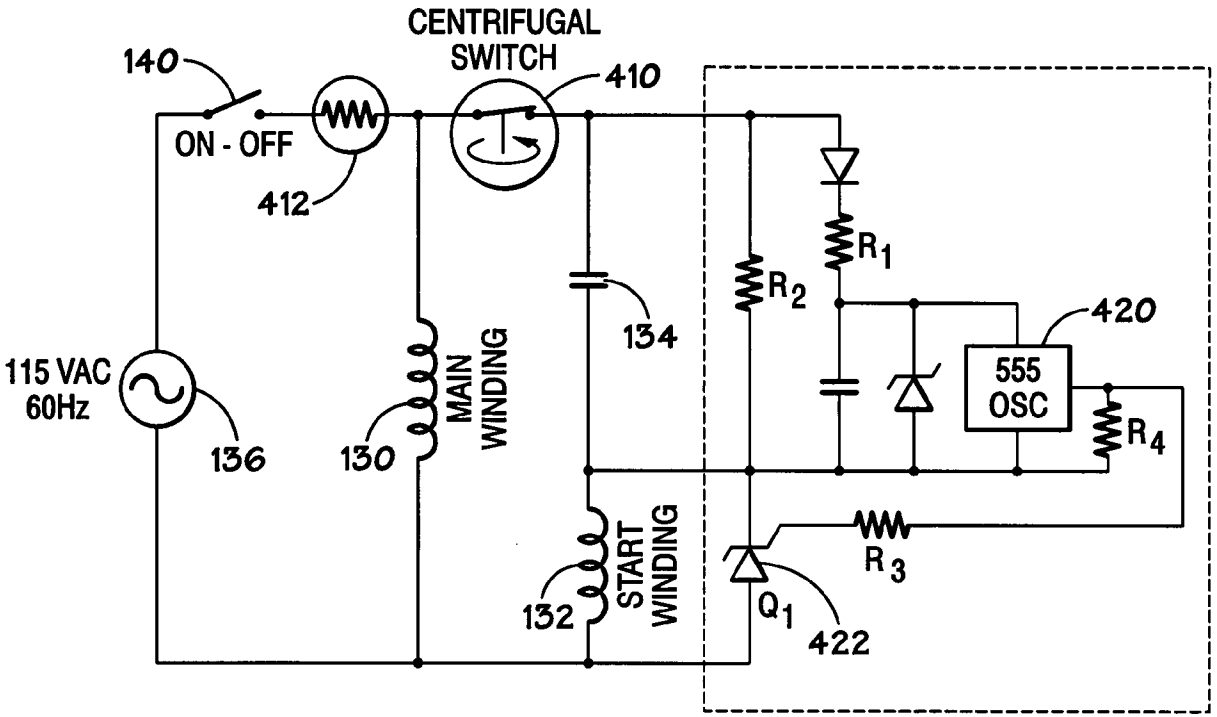
FIG. 6 is a circuit diagram illustrating an alternative motor control circuit.

In an alternative embodiment illustrated in FIG. 6, a centrifugal actuator 410 allows the motor 119 to start under normal conditions. Referring to FIG. 6, the circuit 400 functions as follows:

When the disposer is not in use, the on/off switch 140 is open, and the protector 412 and centrifugal actuator (C/A) switch 410 contacts are closed. When the user applies power to the motor 119 by closing the on/off switch 140, the start winding 132 is energized through the start capacitor 134 and the motor 119 starts up. The start winding 132 remains energized as long as the protector 412 and C/A 410 switches remain closed. Under normal starting conditions, the C/A switch 410 opens when the motor shaft speed reaches about 1000 RPM. This occurs on average in 70 milliseconds. At the same time the on/off switch 140 is closed, power is applied to the de-jam circuit through the C/A switch 410. The de-jam circuit consists of a simple oscillator (555) 420 that produces a 2.5 Hz square wave at a 50% duty cycle, and an SCR 422 in parallel across the start winding 132.

The oscillator 420 is configured such that for the first 200 milliseconds, the output is in the low state, (or off), and the next 200 milliseconds the output is switched high. This sequence will continue indefinitely until power is removed from the circuit by the opening of the C/A switch 410, on/off switch 140, or the protector 412. When the oscillator 420 is in the low state, the SCR 422 is gated off, and the start winding 132 is allowed to operate in its normal mode. When the oscillator 420 is in the high state, the SCR 422 is gated on and shunts the start winding 132 so the pulsating torque mode is produced. Since under normal starting conditions the C/A switch 410 opens on average in 70 milliseconds, the oscillator 420 should never have time to reach the high state since power will be removed before the 200 milliseconds transition point.

If, however, a jam exists, the motor 119 will not be able to accelerate and the C/A switch 410 will not have opened in 200 milliseconds. At that point, the oscillator 420 will transition to the high state and gate the SCR 422 on, producing the pulsating torque. The pulsating torque will be produced for 200 milliseconds (or some other appropriate predetermined time period) in an attempt to clear the jam. If after 200 milliseconds the jam is cleared, the motor 119 will then be able to accelerate normally and open the C/A switch 410 during the subsequent oscillator low state. This will terminate the oscillator cycle. If the jam is not cleared, the oscillator 420 will continue to run producing a pulsating torque at a 200 milliseconds on, 200 milliseconds off rate (2.5 Hz).

If a jam occurs after the motor 119 is up to speed, the de-jam circuit will activate when the motor RPM drops below the C/A switch 410 closure speed of about 800 RPM. Once this happens, the pulsating torque will be produced at a 200 milliseconds on, 200 milliseconds off rate as described above until the jam is cleared or the thermal protector 412 opens.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A method for operating a food waste disposer, comprising: automatically determining if a rotating shredder plate of the food waste disposer is jammed and upon determining that the shredder plate is jammed, operating the food waste disposer in a first de-jamming mode by automatically reversing the rotational direction of the shredder plate at least once; and automatically determining whether the shredder plate was de-jammed by operation of the food waste disposer in the first de-jamming mode and if not, operating the food waste disposer in a second de-jamming mode by automatically applying a pulsed torque to the shredder plate by applying a series of positive torque pulses to the shredder plate where the positive torque pulses are at least two times a normal starting torque of a motor driving the shredder plate.

2. The method of claim 1, wherein automatically determining if the shredder plate is jammed includes determining that it is jammed if the speed of the shredder plate does not reach a predetermined speed during a predetermined time period.

3. The method of claim 1, wherein automatically determining if the shredder plate is jammed includes determining that it is jammed if the speed of the shredder plate falls below a predetermined speed.

4. The method of claim 1, wherein the series of torque pulses are applied for a predetermined time period.

5. The method of claim 1, wherein automatically determining if the shredder plate is jammed includes monitoring current in a winding of a motor driving the shredder plate and determining that the shredder plate is jammed if the current is not below a predetermined level.

6. The method of claim 5, wherein monitoring the winding includes monitoring a run winding of the motor.

7. The method of claim 5, wherein monitoring the winding includes monitoring a start winding of the motor.

8. The method of claim 1, wherein if a jam is determined upon an initial start up of the disposer, reversing the rotational direction of the shredder plate includes energizing a start up winding of the motor.

9. The method of claim 1, wherein applying the series of positive torque pulses includes activating an SCR.

10. The method of claim 9, wherein the SCR is activated during a series of positive or negative halfcycles.

11. A method for operating a food waste disposer, comprising: automatically determining if a rotating shredder plate of the food waste disposer is jammed and upon determining that the shredder plate is jammed, automatically reversing the rotational direction of the shredder plate and applying a pulsed torque to the shredder plate by applying a series of positive torque pulses that are at least two times a normal starting torque of a motor driving the shredder plate.

12. The method of claim 11, wherein automatically determining if the shredder plate is jammed includes determining that the shredder plate is jammed if the speed of the shredder plate does not reach a predetermined speed during a predetermined time period.

13. The method of claim 11, wherein automatically determining if the shredder plate is jammed includes determining that the shredder plate is jammed if the speed of the shredder plate falls below a predetermined speed.

14. The method of claim 11, wherein the series of positive torque pulses are applied for a predetermined time period.

15. The method of claim 11, wherein automatically determining if the shredder plate is jammed includes monitoring a winding of a motor driving the shredder plate.

16. The method of claim 15, wherein monitoring the winding includes monitoring a run winding.

17. The method of claim 15, wherein monitoring the winding includes monitoring a start winding.

18. The method of claim 11, wherein if a jam is detected upon an initial start up of the rotating member, reversing the rotational direction of the shredder plate includes energizing a start up winding of the motor.

19. The method of claim 11, wherein applying the series of positive torque pulses includes activating an SCR.

20. The method of claim 19, wherein the SCR is activated during a series of positive or negative halfcycles.

* * * * *